US007896035B2

(12) United States Patent
Ueda et al.

(10) Patent No.: US 7,896,035 B2
(45) Date of Patent: Mar. 1, 2011

(54) INDUSTRIAL MULTILAYER FABRIC HAVING A NARROWING WEFT

(75) Inventors: Ikuo Ueda, Shizuoka (JP); Yoshihisa Kondo, Shizuoka (JP)

(73) Assignee: Nippon Filcon Co., Ltd., Tokyo (JP)

( * ) Notice: Subject to any disclaimer, the term of this patent is extended or adjusted under 35 U.S.C. 154(b) by 0 days.

(21) Appl. No.: 12/591,098

(22) Filed: Nov. 9, 2009

(65) Prior Publication Data

US 2010/0119787 A1 May 13, 2010

(30) Foreign Application Priority Data

Nov. 12, 2008 (JP) ..... 2008-289440

(51) Int. Cl.
*D03D 3/04* (2006.01)
*D21F 7/08* (2006.01)
*D03D 25/00* (2006.01)

(52) U.S. Cl. ..... 139/383 A; 139/383 R; 162/358.2

(58) Field of Classification Search ..... 139/383 R, 139/383 A, 383 AA, 408, 411, 412, 413, 139/414; 162/348, 358.1, 358.2, 900, 902, 162/903, 904

See application file for complete search history.

(56) References Cited

U.S. PATENT DOCUMENTS 3,851,681 A * 12/1974 Egan ..... 139/420 R
4,314,589 A * 2/1982 Buchanan et al. ..... 139/383 A
4,423,755 A * 1/1984 Thompson ..... 139/383 A
4,499,927 A * 2/1985 Borel ..... 139/425 A
4,592,396 A * 6/1986 Borel et al. ..... 139/425 A
4,941,514 A * 7/1990 Taipale ..... 139/383 A
4,985,084 A * 1/1991 Hakkarainen et al. ... 139/383 A
4,987,929 A * 1/1991 Wilson ..... 139/383 A
4,989,647 A * 2/1991 Marchand ..... 139/383 A
5,013,330 A * 5/1991 Durkin et al. ..... 51/297

(Continued)

FOREIGN PATENT DOCUMENTS

EP 1 724 382 A1 11/2006

(Continued)

OTHER PUBLICATIONS

Communication from European Patent Office for Application No. 09252598.9 dated Feb. 22, 2010.

*Primary Examiner*—Bobby H Muromoto, Jr.
(74) *Attorney, Agent, or Firm*—Rader, Fishman & Grauer PLLC

(57) ABSTRACT

In an industrial multilayer fabric, narrower wefts of a small diameter are placed between lower side wefts so as to sandwich a knuckle formed by a lower side warp on the lower surface side of the fabric. The industrial fabric is obtained by stacking at least upper side wefts and lower side wefts one after another and weaving these wefts with warps. Narrower wefts that have a smaller diameter than that of the lower side wefts and form a shorter crimp than that formed by the lower side wefts on the lower side surface are arranged between the lower side wefts. And at a knuckle portion formed by warps passing under one or two successive lower side wefts, the narrower wefts form a crimp passing under lower side warps so as to sandwich, from both sides, one knuckle or two knuckles formed by two adjacent warps under two adjacent wefts.

7 Claims, 14 Drawing Sheets

U.S. PATENT DOCUMENTS 5,101,866 A * 4/1992 Quigley ..... 139/383 A
5,158,117 A * 10/1992 Huhtiniemi ..... 139/383 A
5,487,414 A * 1/1996 Kuji et al. ..... 139/383 A
5,555,917 A * 9/1996 Quigley ..... 139/383 A
5,840,378 A * 11/1998 Nagura et al. ..... 428/57
5,887,630 A * 3/1999 Shipley ..... 139/383 A
6,202,705 B1 * 3/2001 Johnson et al. ..... 139/383 A
6,581,645 B1 * 6/2003 Johnson et al. ..... 139/383 A
6,740,203 B2 * 5/2004 Zilker ..... 162/306
6,769,535 B2 * 8/2004 Zilker et al. ..... 198/847
6,899,143 B2 * 5/2005 Rougvie et al. ..... 139/383 A
6,902,652 B2 * 6/2005 Martin ..... 162/348
7,008,512 B2 * 3/2006 Rougvie et al. ..... 162/348
7,059,361 B1 * 6/2006 Hansson ..... 139/383 A
7,357,156 B2 * 4/2008 Ueda et al. ..... 139/383 A

FOREIGN PATENT DOCUMENTS

JP 2006-322109 A 11/2006
JP 2006-322109 A 11/2006

* cited by examiner

FIG. 13
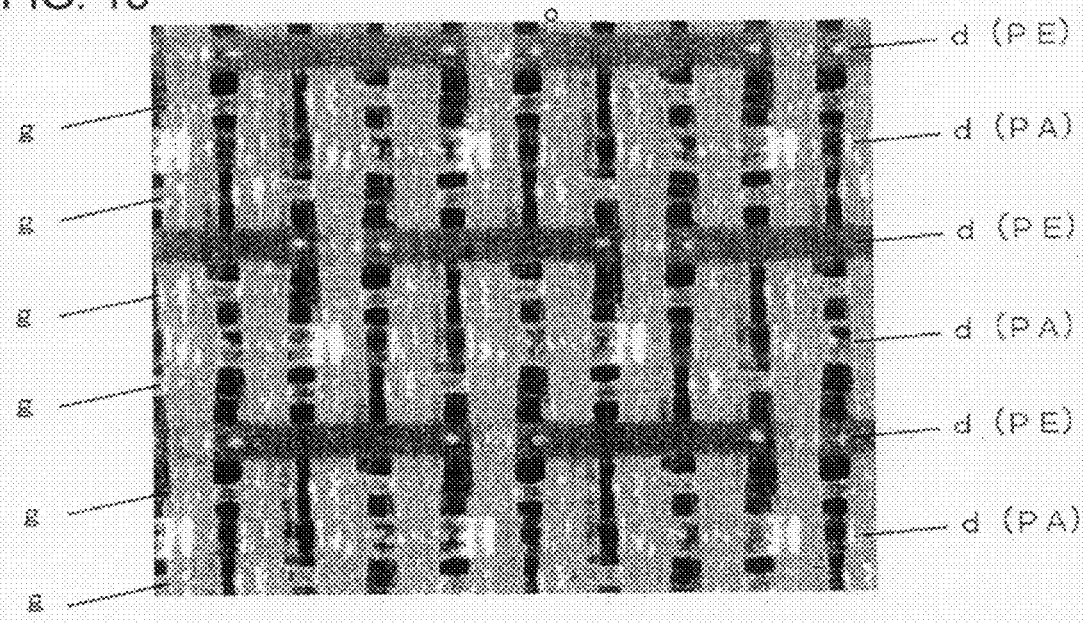
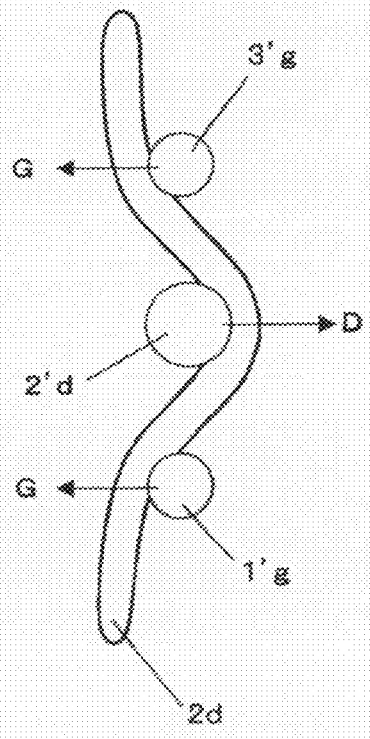
FIG. 14

INDUSTRIAL MULTILAYER FABRIC HAVING A NARROWING WEFT

CROSS-REFERENCES TO RELATED APPLICATION

This application claims priority from Japanese Patent Application Serial No. 2008-289440 filed Nov. 12, 2008, the contents of which are incorporated herein by reference in its entirety.

BACKGROUND OF THE INVENTION

1. Field of the Invention

The present invention relates to industrial multilayer fabrics having improved rigidity and wear resistance and also having improved strength at a joining portion where yarns are joined in an endless manner by weaving. Such advantages are actualized by employing a structure in which narrower wefts of a small diameter are arranged between lower side wefts so as to sandwich therebetween a knuckle formed by warps on the lower surface side.

2. Description of the Related Art

Fabrics formed by weaving warps and wefts have heretofore been used widely as an industrial fabric, for example, papermaking fabrics, conveying belts, and filter cloths. They are required to have fabric properties suited for using purposes or using environments. Requirements for papermaking fabrics to be used in a papermaking step for removing water from raw materials by utilizing meshes of the fabrics are especially strict. For example, there is a demand for fabrics that do not easily transfer a wire mark of the fabrics to paper and are therefore superior in surface property, fabrics having a dehydration property to enable complete removal of excess water contained in the raw materials and having sufficient rigidity and wear resistance to enable suitable use of it even under severe environments, and fabrics capable of retaining conditions necessary for making excellent paper for a long period of time.

There is also a demand for fabrics having a fiber supporting property, capable of improving a papermaking yield, having size stability, and having running stability, and the like. The demand for papermaking fabrics has become severe with a recent increase in the speed of a papering machine.

Among industrial fabrics, papermaking fabrics must satisfy the most severe requirements so that description on them will promote understanding of the requirements and solutions of most of the industrial fabrics. Therefore, one example of the papermaking fabrics will hereinafter be described.

In typical industrial fabrics, fabrics are traveled by joining the fabrics, which have been obtained by weaving to have ends, in an endless manner by the conventional method, suspending them in a plurality of rollers, and travelling the rollers while applying a tension thereto.

In order to actualize this, fabrics are required to have elongation resistance, a stable shape, resistance against wear caused by the contact with the rollers, and a joining strength strong enough to prevent disconnection of a joint, which has been made endless, even in travelling under tension.

Two-layer fabrics made by weaving a closely woven fabric using yarns of a small diameter on a side contiguous to wet paper with a coarsely woven fabric using yarns of a large diameter on a side contiguous to the rollers of a machine can usually have all of surface smoothness, rigidity, and dehydration property. As an arrangement ratio of wefts is described in Examples or Claim 8 of Japanese Patent Application Laid-Open No. 2006-322109, there has conventionally been known a weft long crimp structure in which the number of lower side wefts is made smaller than that of upper side wefts to improve a dehydration property and rigidity and wefts are made responsible for wear for the purpose of improving wear resistance.

SUMMARY OF THE INVENTION

Since the number of lower side wefts is reduced and wefts have a long crimp structure, however, the number of confounding portions decreases. As a result, such fabrics have deteriorated rigidity and contain many undesirable movements of yarns. In addition to these problems, the strength of the joining portion which has been made endless decreases, because the diameter of constituent yarns is made smaller to thin the wire thickness and thereby reduce water retained by the wire or the number of confounding portions decreases.

An object of the present invention is to provide an industrial multilayer fabric excellent in rigidity, wear resistance, and joining strength when formed in an endless manner by arranging narrower wefts of a small diameter between lower side wefts so that a knuckle formed by lower side warps on the lower surface side is sandwiched between the narrower wefts.

The greatest characteristic of the industrial multilayer fabric of the present invention resides in that narrower wefts of a small diameter are arranged between lower side wefts so as to sandwich a knuckle formed by warps on the lower surface side. Since the narrower wefts are effective for improving the weaving strength of warps, they contribute to the formation of a fabric which does not expand easily and in addition, they have an excellent effect for improving size stability, running stability, and joining strength.

The present inventors adopted the following constitutions in order to overcome the aforementioned problems.

(1) There is provided an industrial multilayer fabric obtained by stacking at least upper side wefts and lower side wefts one after another and weaving them with warps, wherein narrower wefts having a smaller diameter than that of the lower side wefts and forming a shorter crimp than that formed by the lower side wefts on the lower side surface are arranged between the lower side wefts; and at a knuckle portion formed by the warps passing under one or two successive lower side wefts, the narrower wefts form a crimp passing under lower side warps so as to sandwich, from both sides, one knuckle or two knuckles formed by two adjacent warps under two adjacent wefts.

(2) There is also provided the industrial multilayer fabric as described above in (1), wherein the narrower wefts and the lower side wefts are arranged at a ratio of 1:1 or 1:2.

The industrial multilayer fabric of the present invention is characterized in that narrower wefts of a small diameter are arranged between lower side wefts. Since the narrower wefts are effective for improving the weaving strength of the lower side warps, they contribute to the formation of a fabric which does not expand easily and in addition, they have an excellent effect for improving size stability, running stability, and joining strength.

(3) There is also provided the industrial multilayer fabric as described above in (1) or (2), wherein the multilayer fabric has any one of a single warp-double weft structure, a double warp-double weft structure, and a single warp-triple weft structure.

(4) There is also provided the industrial multilayer fabric as described above in any of (1) to (3), wherein the multilayer fabric is obtained by weaving with a single warp binding yarn, a pair of warp binding yarns, a single weft binding yarn, or a pair of weft binding yarns.

(5) There is also provided the industrial multilayer fabric as described above in any of (1) to (4), wherein the narrower wefts arranged between the lower side wefts have one design or two or more different designs.

The narrower wefts are arranged between the lower side wefts and they have a smaller diameter than that of the lower side wefts and at the same time, they form a shorter crimp (float) than that of the lower side wefts on the lower side surface. The narrower wefts form, at a knuckle portion formed by a warp passing under one or two successive lower side wefts, a crimp under the lower side warp so as to sandwich the knuckle from both sides. A fabric using a warp binding yarn has improved binding strength because a lower side knuckle of the warp binding yarn is also sandwiched between narrower wefts.

Since at confounding portions, the lower side warps (and warp binding yarns) change their shape along the shape of the lower side wefts due to the presence of the narrower wefts, the knuckle is fixed and undesirable movements of yarns in the fabric decrease. For the same reason, the presence of the narrower wefts improves the joining strength. Moreover, different from small-diameter binding yarns used for conventional double warp-double weft weft-binding structure fabrics, the narrower wefts do not serve as a binding yarn so that internal wear which will otherwise occur due to deterioration in weaving strength of upper and lower layers caused by wear of the narrower wefts does not occur. Even in the event that the narrower wefts are worn away, it does not become a direct reason for replacement with another wire.

As the design of the narrower wefts, a design in which they pass under one or more lower side warps is preferred and they have desirably a design of forming a shorter crimp than that formed by lower side wefts on the lower side surface. The narrower wefts having a design of forming an excessively long crimp may inhibit the object of the present invention, that is, improvement in weaving strength of warps. Moreover, a long crimp may protrude from the rear surface of the fabric and the narrower wefts of a small diameter may become worn first so that such narrower wefts are not preferred.

In addition, the narrower wefts have a design in which they pass, at a knuckle portion formed by a warp passing under one or two successive lower side wefts, under the warps so as to sandwich from both sides a knuckle or two knuckles formed by two adjacent warps under two adjacent wefts. From the cross-sectional photograph of a warp binding yarn in FIG. 12, it is apparent that a warp has a knuckle along the shape of the lower side weft, sandwiched from both sides.

As described above, the present invention includes two cases, that is, the first case where a knuckle or two knuckles formed by a warp or two adjacent warps passing under one weft is/are sandwiched by two adjacent crimps formed by two adjacent narrower wefts on both sides of the knuckle (FIGS. 1 to 9 and 14) and the second case where two lower side knuckles formed by two adjacent warps under two adjacent wefts are sandwiched diagonally from both sides by the two adjacent crimps formed by the two adjacent narrower wefts (FIGS. 11 and 15).

Here, a narrowing effect of the lower side knuckle produced by the arrangement of narrower wefts is described. The effect in the first case is described referring to FIG. 14. Warp 2*d* forms a knuckle passing under one Lower side weft 2'*d* and on both sides of the knuckle, narrower wefts are arranged so as to pass over Warp 2*d*. Under such a structure, Downward force D acts at the lower side weft, while Upward force G acts at the narrower wefts. Accordingly, the warp becomes convex downward at which it passes under the lower side weft and this convex shape is emphasized, lifted up on both sides by the narrower wefts. As a result, the warp has a strongly confounding knuckle shape as if it wraps the lower side weft therewith.

The effect in the second case is described referring to FIG. 15. Warp 3*d* has a design in which it passes over narrower weft 4'*g*, passes under Lower side weft 5'*d*, and passes over Lower side weft 6'*d*, while Warp 4*b* has a design in which it passes over Lower side weft 5'*d*, passes under Lower side weft 6'*d*, and passes over narrower weft 7'*g*.

Downward force 3D acts on Warp 3*d* at which it passes under the lower side weft, while Upward force 3G acts on it at which it passes over narrower weft 4'*g* and Lower side weft 6'*d*. Accordingly, similar to FIG. 14, the warp becomes convex downward at which it passes under the lower side weft and this convex shape is emphasized, lifted up on both sides by the narrower wefts. As a result, the warp has a strongly confounding knuckle shape as if it wraps the lower side weft therewith.

Similar forces act on another Warp 4*b*. Described specifically, Downward force (4D) acts on Warp 4*b* at which it passes under Lower side weft 6'*d*, while Upward forces (4G, 4G) act on it at which it passes over the Warp 5'*d* and narrower weft 7'*g* on both sides so that the warp has a strongly confounding knuckle shape as if it wraps the lower side weft therewith.

In the above description, a warp passes under one lower side weft. This also applies to a knuckle portion at which a warp passes under two successive lower side wefts. A downward force acts on the warp at which it passes under the two lower side wefts at the center, while an upward force acts on it at which it passes over the narrowing warps on both sides so that the warp has a strongly confounding knuckle shape as if it wraps the lower side wefts therewith.

FIG. 12 includes cross-sectional photographs of two warps for comparison. The warp (a) of FIG. 12 is a cross-sectional photograph of a warp binding yarn of double warp-double weft warp-binding structure fabric according to the present invention, while the warp (b) of FIG. 12 is a cross-sectional photograph of a warp binding yarn of double warp-double weft warp-binding structure fabric according to the conventional art. The fabric of the conventional art and the fabric of the present embodiment are similar to each other in conditions and structure except that the former one has no narrower weft. Although they are similar, they vary greatly in the knuckle shape on the lower surface side (a portion surrounded by a white dotted line). In the present invention (a) of FIG. 12, the knuckle shape is formed by downward pushing of the warp by the lower side weft and upward pushing of the warp by the narrower wefts on both sides. Thus, it can be understood that the warp and weft are woven strongly at the knuckle portion.

It can be confirmed, on the other hand, that in the case of warp (b) of conventional art, the warp becomes convex downward by downward pushing of the warp by the lower side weft but it does not have a knuckle shape as if it wraps the lower side weft therewith.

Strong confounding as in the present embodiment enables to decrease undesirable movements of the fabric, stabilize the shape, and improve the rigidity. Since the narrower wefts are arranged, lower side warps can push out the lower side wefts. This increases a wear volume of the wefts (meaning that warps do not protrude from the rear surface) and improves wear resistance. In some designs, the narrower wefts can be functioned, similar to the lower side wefts, as a yarn responsible for wear.

In addition, strength at a joining portion at which fabrics having ends are joined in an endless manner can be improved. In the publicly-known joining method, a portion obtained by unravelling yarns at both ends of the fabric having ends and removing only wefts and another portion obtained by removing warps, that is, the remaining warps and the remaining wefts, are prepared and are woven together in an endless manner along a knuckle shape into the original design. When the warp has a firm knuckle shape, a joint does not drop off during traveling under a high tension because the weft has an improved retaining force.

In addition, the diameter of the narrower wefts is made smaller than that of the lower side wefts. The lower side layer is usually made of more coarse and wider yarns than those of the upper side layer in order to impart rigidity and dehydration property to the lower side layer. Arrangement of yarns as wide as the lower side wefts in the lower side layer may clog the mesh to deteriorate air permeability and dehydration property. The narrower wefts are arranged alternately with the lower side wefts or arranged at 1:2, meaning that the number of the narrower wefts is equal to or smaller than that of the lower side wefts. Successive arrangement of two narrower wefts is not preferred because it may impair the air permeability and dehydration property.

The narrower wefts are placed between the lower side wefts of the lower layer and they have, in the upper layer thereof, upper side wefts. Wefts constituting the upper layer and lower layer may be arranged at any ratio of 1:1, 2:1 and 3:2.

The preferred design of the narrower weft is as described above. Narrower wefts of one design may be arranged or two or more narrower wefts different in design may be arranged alternately between the lower side wefts.

The fabric of the present invention is not particularly limited insofar as it is a multilayer fabric having at least a structure obtained by weaving upper side wefts and lower side wefts with warps and it is characterized in that narrower wefts may be arranged between the lower side wefts. This multilayer fabric may employ any structure or any binding method. Examples of the structure include single warp-double weft, double warp-double weft, and single warp-triple weft. The upper and lower layers may be woven with a single warp binding yarn or weft binding yarn or a pair of single warp binding yarns or weft binding yarns. Since the narrower wefts are however placed between the lower side wefts in the present invention, a weft binding structure should be employed in consideration of air permeability, dehydration property, and the like. It is preferred to employ a warp binding structure.

No particular limitation is imposed on the upper side surface design and any of plain weave, twill weave, and sateen weave may be selected as needed. With regard to the lower side surface design, lower side wefts may have a design capable of forming a long crimp on the lower side surface and it may be determined, depending on the design or arrangement of narrower wefts. Examples of the design include a design in which a lower side weft passes over two lower side warps and then passes under six lower side wefts and a design in which a lower side weft passes over one lower side warp and then passes under three or seven lower side wefts. According to this design of the lower side wefts, the design of narrower wefts may be determined. It is, for example, repetition of a design in which it passes over one lower side warp and then under three lower side warps or a design in which it passes over one lower side warp, passes under two lower side warps, passes over one lower side warp, and passes under four lower side warps in the order of mention.

Yarns to be used in the present invention may be selected depending on the using purpose. Examples of them include, in addition to monofilaments, multifilaments, spun yarns, finished yarns subjected to crimping or bulking such as so-called textured yarn, bulky yarn and stretch yarn, and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ether ketone, polyethylene naphthalate, polytetrafluoroethylene, cotton, wool and metal. Of course, yarns obtained using copolymers or incorporating or mixing the above-described material with a substance selected depending on the intended purpose may be used.

Various materials are usable as a papermaking wire. It is preferred to use polyester monofilaments having rigidity and excellent size stability as upper side warps, lower side warps, warp binding yarns, and upper side wefts. As lower side wefts which require wear resistance, those obtained by interweaving a polyester monofilament and a polyamide filament, for example, by disposing them alternately are preferred because the fabric using such a weft has improved wear resistance while maintaining rigidity. As narrower wefts, yarns selected freely from polyester monofilaments and polyamide monofilaments are usable.

With regard to the diameter of constituent yarns, the upper side wefts have preferably a smaller diameter than that of the lower side wefts in light of surface property and a weft arrangement ratio. The narrower wefts having a diameter not greater than two thirds of the lower side wefts can produce their narrowing effect fully without inhibiting air permeability and dehydration property. The diameter of the narrower wefts is adjusted to preferably about half of that of the lower side wefts. For example, it is preferred to adjust the diameter of the narrower wefts to 0.11 mm when the diameter of the lower side wefts is 0.23 mm.

As can be confirmed from the photograph of FIG. 13 showing the plane of the lower side surface, narrower wefts (g) of a small diameter are arranged between alternately arranged lower side wefts d(PE) made of polyester and lower side wefts d(PA) made of polyamide. By such an arrangement, the lower side knuckle of a warp is narrowed and actualizes strong confounding weaving with a lower side weft as is apparent from the cross-sectional photograph of the warp in FIG. 12.

Since narrower wefts of a small diameter are arranged so as to sandwich a knuckle, which is formed by a warp passing under one or two successive lower side wefts, from both sides of the knuckle, the present invention is effective for providing an industrial fabric having improved rigidity, wear resistance, and dehydration property.

BRIEF DESCRIPTION OF THE DRAWINGS

FIG. 13 is a photograph showing the plane of the lower side surface of Embodiment 1;

FIG. 14 is a cross-sectional view illustrating the vicinity of a knuckle formed by the warp of Embodiments 1 to 9 on the lower surface side.

DESCRIPTION OF REFERENCE NUMERALS AND SIGNS

1*u*, 3*u* . . . upper side warp;
2*d*, 4*d* . . . lower side warp;
1*b*, 2B . . . warp binding yarn;
1'*u*, 2'*u* . . . upper side weft;
1'*d*, 5'*d* . . . lower side weft; and
3'*g*, 7'*g* . . . narrower weft.
D . . . Direction of force by which warp is pushed down by lower side weft.
G . . . Direction of force by which warp is pushed up by narrower weft.

DESCRIPTION OF THE PREFERRED EMBODIMENTS

The embodiments of the present invention will hereinafter be described referring to accompanying drawings.

FIGS. 1 to 9 and 11 are design diagrams of Embodiments of the present invention.

A design diagram is a minimum repeating unit (which may also be called "complete design") of a fabric design and a whole fabric design is formed by connecting this complete design longitudinally and latitudinally. In the design diagram, warps are indicated by Arabic numerals, for example 1, 2 and 3. Warp binding yarns for weaving upper and lower wefts are indicated by Arabic numerals with b, other warp binding yarns are indicated by Arabic numerals with B, upper side warps are indicated by Arabic numerals with u, and lower side warps are indicated by Arabic numerals with d.

Wefts are indicated by Arabic numerals with a prime, for example, 1', 2' and 3'. Some of the wefts are an upper side weft and a lower side weft arranged vertically; some are an upper side weft and a narrower weft arranged vertically; and some are composed only of an upper side weft, which is determined depending on an arrangement ratio of wefts. Upper side wefts are indicated by attaching "u" to Arabic numerals and lower side wefts are indicated by attaching "d", for example 1'*u*, 2'*d*. Narrower wefts are indicated by attaching "g" to Arabic numerals, for example, 3'*g*, 7'*g*, and 11'*g*.

Figure 9:
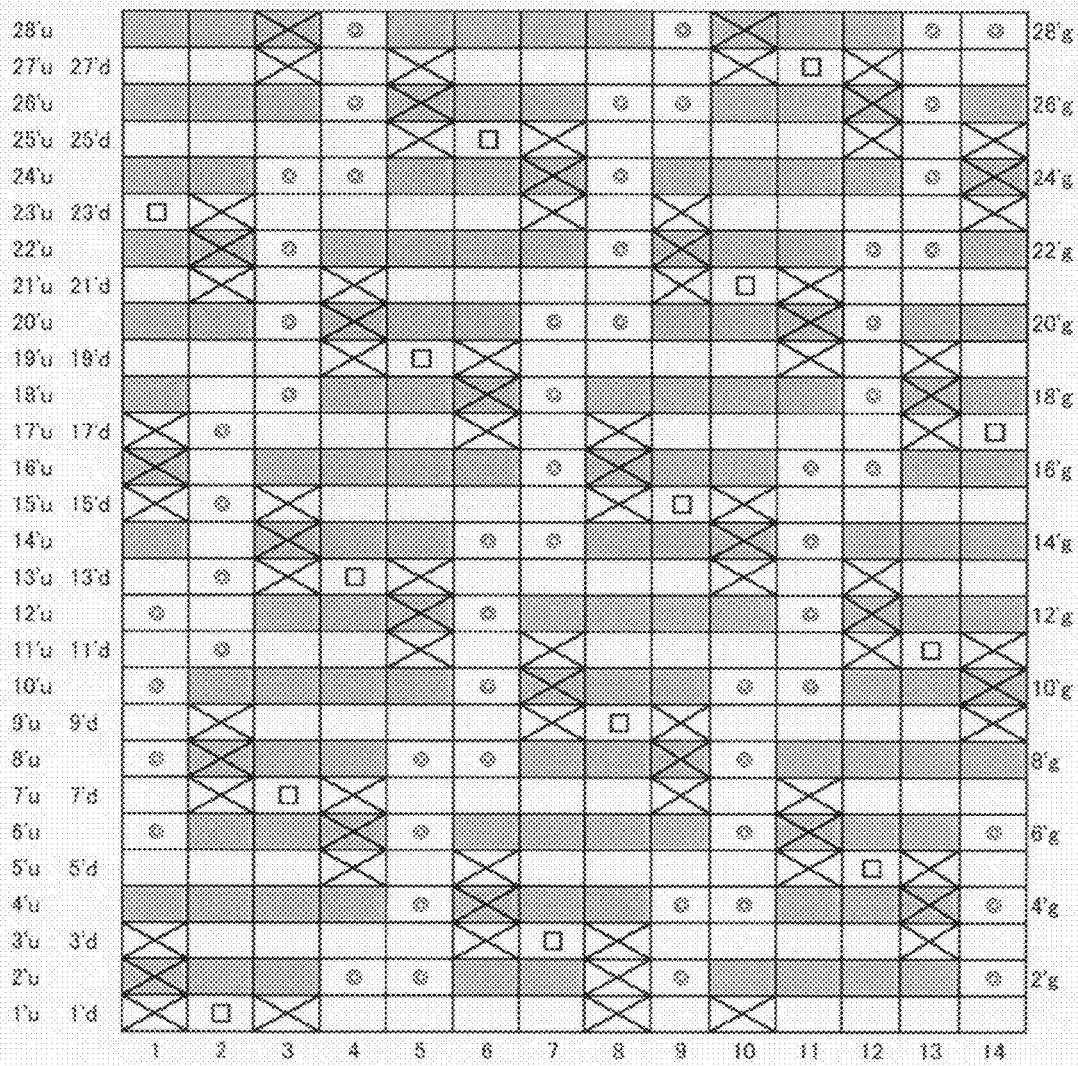
FIG. 9 is a design diagram illustrating a complete design of Embodiment 9 according to the present invention.

In these design diagrams, a mark "x" means that an upper side warp lies over an upper side weft; a mark "□" indicates that a lower side warp lies under a lower side weft. FIG. 9 is, as illustrated in the cross-sectional view of FIG. 10 taken along the warp, a design diagram of a fabric having a single warp-triple weft structure. Since there is only one warp passing through an intermediate layer and weaving upper and lower layers, some marks have a different meaning. The mark "x" means that a warp is located over an upper side weft, the mark "□" means that the warp is located under a lower side weft, and the mark "◎" means that a narrower weft passes under an intermediate weft and over a lower side weft. Detailed description on whether a warp passes between an upper side weft and an intermediate weft or between an intermediate weft and a lower side weft is omitted from FIG. 9, but those skilled in the art can understand the structure from the observation of both FIG. 9 and the cross-sectional view of FIG. 10.

A mark "•" indicates that a warp binding yarn (b) lies over an upper side weft and forms a knuckle; a mark "○" indicates that the warp binding yarn (b) lies under a lower side weft and forms a knuckle; a mark "◆" also indicates that a warp binding yarn (B) lies over an upper side weft and forms a knuckle; and a mark "◇" indicates that the warp binding yarn (B) lies under a lower side weft and forms a knuckle. Portions where a narrower weft (g) forms a long crimp on a lower side surface are hatched.

When warp binding yarns (b, B) and lower side warps (d) form a knuckle while being located under narrower wefts, the marks ○ ◇ □ are made smaller. In the design diagrams, yarns are vertically overlapped precisely. They are however illustrated as such for convenience of drawing and misalignment sometimes occurs in the actual fabric.

Embodiment 1

Figure 1:
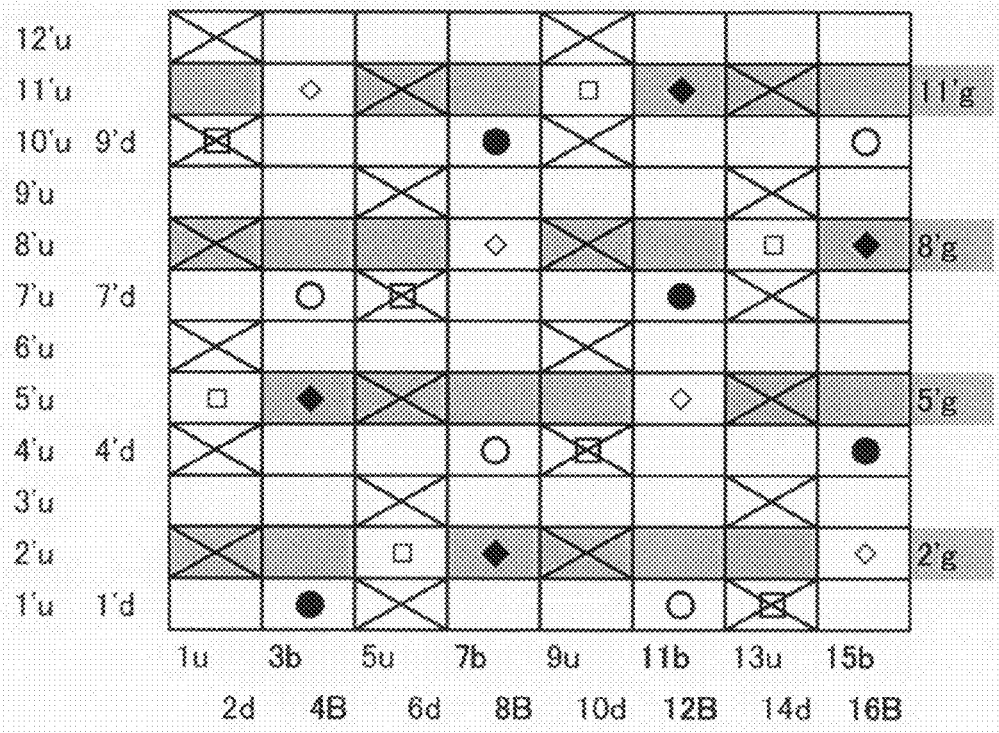
FIG. 1 is a design diagram illustrating a complete design of Embodiment 1 according to the present invention.

FIG. 1 is a design diagram of a double warp-double weft warp-binding structure according to Embodiment 1 of the present invention. In addition to upper side warps (u) and lower side warps (d), there are four pairs of a warp binding yarn (b) and a warp binding yarn (B). Narrower wefts are arranged alternately with lower side wefts and an arrangement ratio of upper side wefts to lower side wefts is 3:2.

As shown in the photograph of FIG. 13 illustrating the reverse side of the embodiment of the present invention, narrower wefts are placed between lower side wefts. The narrower wefts have a smaller diameter than lower side wefts and form a shorter crimp than that of lower side wefts on the lower side surface. According to this embodiment, lower side wefts each has a design in which it passes over two warps and then under six warps. narrower wefts each has a design in which it passes over one warp, under two warps, over one warp, and under four warps.

Narrower wefts form, at a knuckle portion "○" formed by a lower side warp (and a warp binding yarn) passing under one lower side weft, crimps (shaded portions in FIG. 1) on the lower side surface so as to sandwich the knuckle "○" from both sides. According to the design diagram, at a knuckle portion formed by Warp binding yarn 7*b* and Lower side warp 10*d* passing under Lower side weft 4'*d*, narrower wefts 2'*g* and 5'*g* are on both sides of the knuckle. Narrower weft 2'*g* forms a crimp passing under Warps 8B, 10*d*, 12B, and 14*d* and narrower weft 5'*g* forms a crimp passing under Warps 4B, 6*d*, 8B, and 10*d*. The knuckle of the lower side warp is sandwiched from both sides by these crimps, which can be understood also from the warp (a) of FIG. 12.

Figure 12:
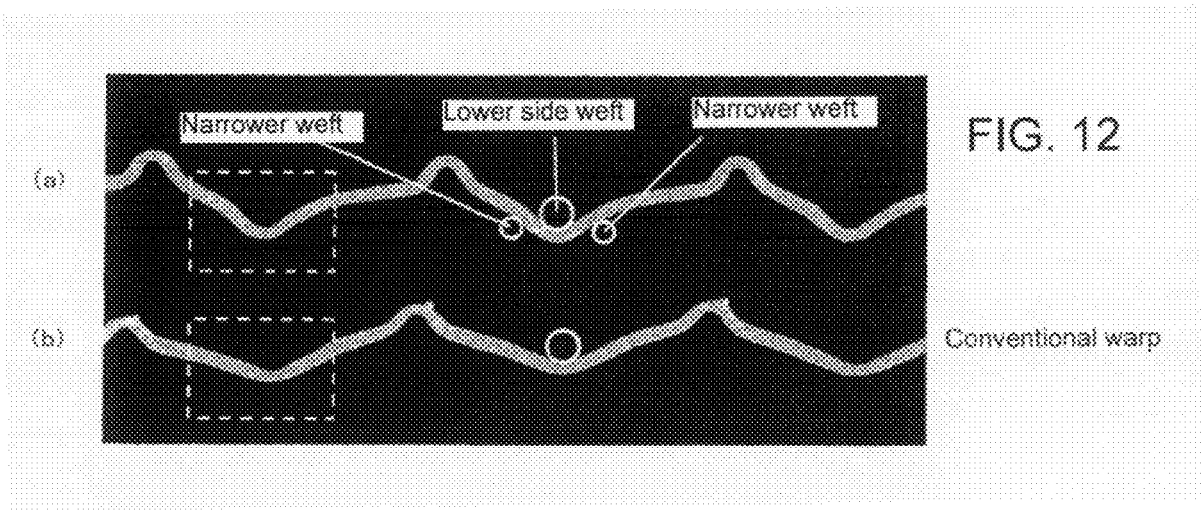
In FIG. 12, (a) is a warp of a cross-sectional photograph of Embodiment 1 taken along the warp binding yarn and (b) is another warp of a cross-sectional photograph of the conventional art taken along a warp binding yarn.

The cross-sectional photograph of warp (a) of FIG. 12 shows a warp binding yarn 4B separated from the fabric of the present embodiment, while the cross-sectional view of warp (b) of FIG. 12 shows a warp binding yarn of the conventional-art fabric similar to the fabric of FIG. 1 except that it has no narrower yarn. Since a warp binding yarn also has a weaving portion with a lower side weft so that it produces a similar effect to that of a lower side warp.

Comparison between these two photographs has revealed that they are clearly different in the shape of a knuckle portion passing under a lower side weft (refer to the shape of a knuckle portion surrounded by a white dotted line of FIG. 12). In the knuckle portion of the present embodiment warp (a), presence of narrower wefts on both sides of the knuckle enables to form a shape as if they wraps lower side weft therewith. On the other hand, a lower side knuckle of a warp of the conventional-art fabric bends because the warp moves up or down, but the shape of the confounding portion is not so stable as to wrap the lower side weft therewith.

When the confounding portion becomes stable, warps and wefts are fixed and do not move easily. This leads to improvement in the rigidity of the fabric and as a result, the fabric has improved expansion resistance, size stability, and running stability. In addition, when endless fabrics are joined by weaving them with ends by the known method, the resulting fabric has improved joining strength. These effects are all available by arrangement of narrower wefts to stabilize the knuckle portion.

Embodiment 2

Figure 2:
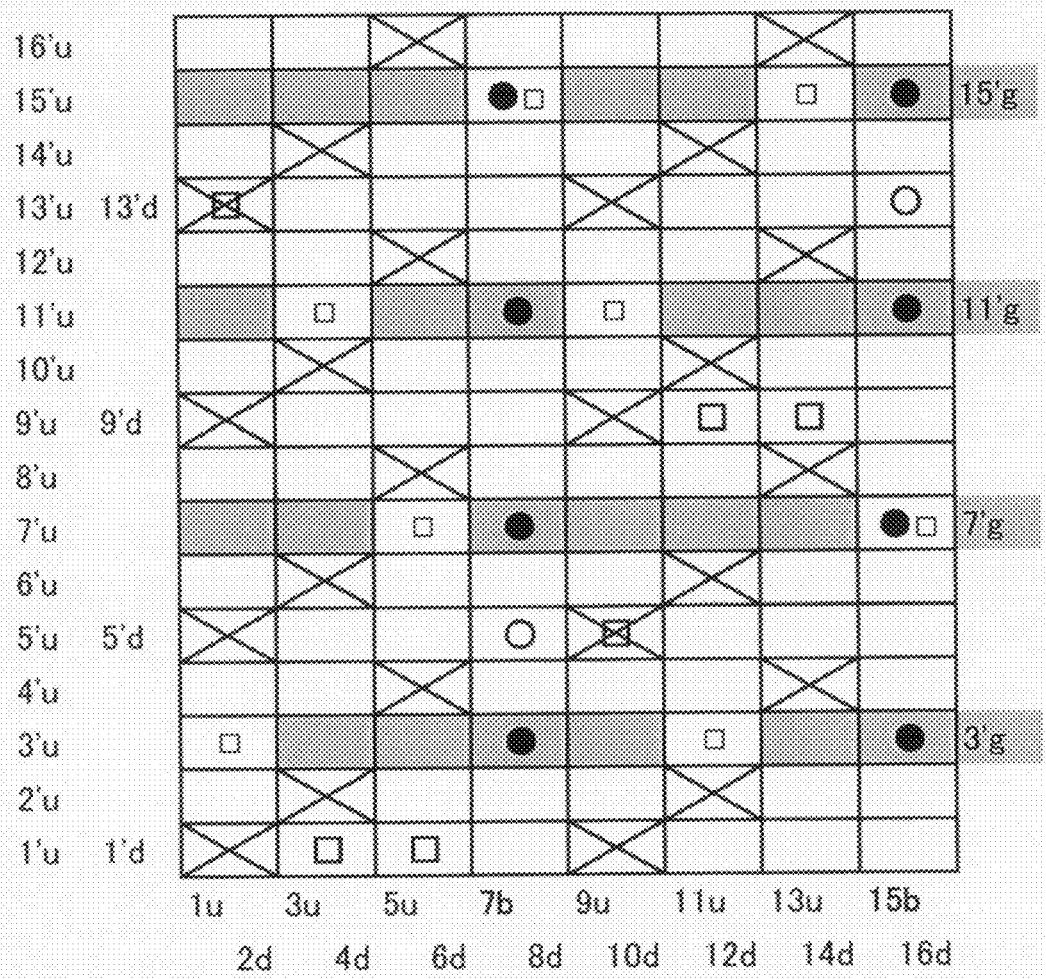
FIG. 2 is a design diagram illustrating a complete design of Embodiment 2 according to the present invention.

FIG. 2 is a design diagram of a fabric according to Embodiment 2 of the present invention. It is similar to the fabric of the above Embodiment and has a double warp-double weft warp-binding structure, but different in that a pair of warp binding yarns is composed of a warp binding yarn (b) and a lower side warp (d) and in an arrangement ratio, surface design, and an upper weft/lower weft ratio of 2:1. In Embodiment 1, a warp binding yarn is not involved in the formation of a surface design, while in the present embodiment, a warp binding yarn has both a function of a binding yarn and a function of an upper side warp. Upper side warps and warp binding yarns are woven with upper side wefts to form a sateen weave design.

Narrower wefts form, at a knuckle portion "○" formed by a lower side warp passing under a lower side weft, crimps on the lower side surface (shaded portions) so as to sandwich the knuckle from both sides. This enables to form a fabric having improved rigidity, expansion resistance, size stability, and running stability. In addition, when endless fabrics are joined with ends by the known method, the resulting fabric has improved joining strength.

Embodiment 3

Figure 3:
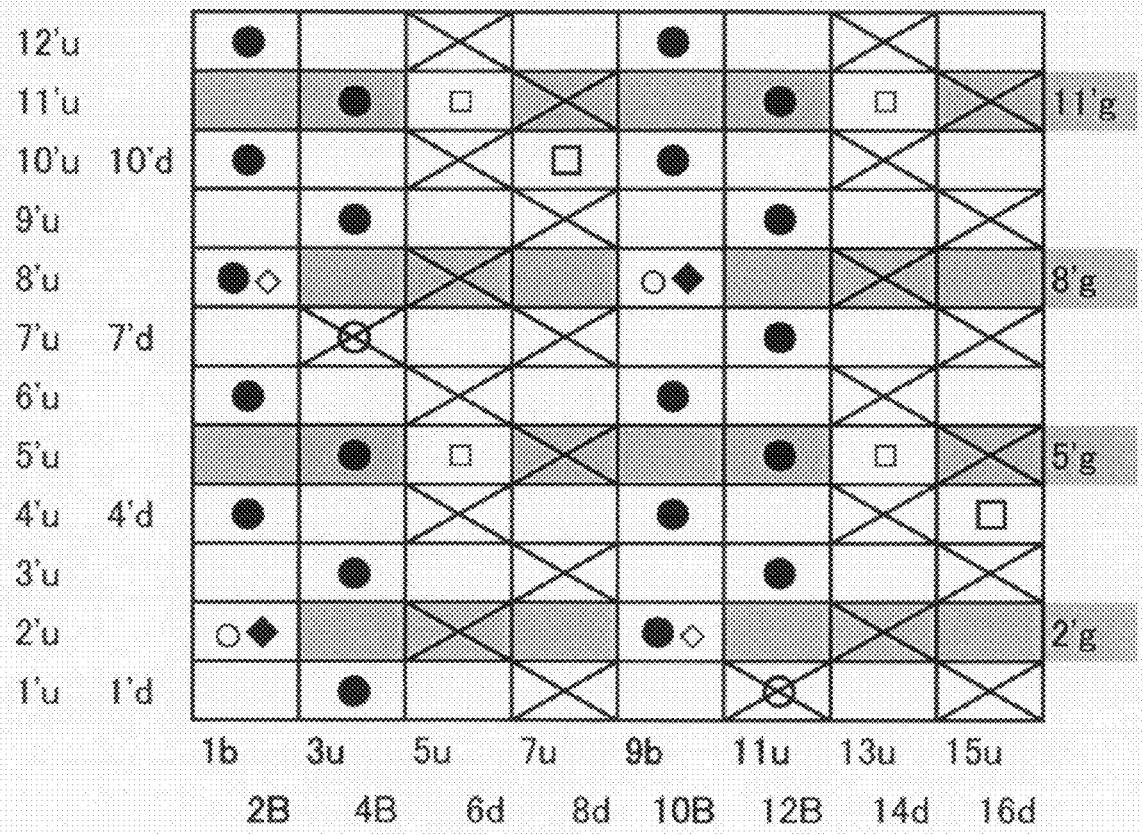
FIG. 3 is a design diagram illustrating a complete design of Embodiment 3 according to the present invention.

FIG. 3 is a design diagram of a fabric according to Embodiment 3 of the present invention. It is different from Embodiment 1 in the arrangement of warp binding yarns. The fabric of this embodiment has a pair of two warp binding yarns (b, B) and a pair of an upper side warp (u) and a warp binding yarn (B). Lower side wefts each passes over one warp ("○" or "□") to form a knuckle portion and then passes under seven warps to form a long crimp. Narrower wefts each repeats a design in which it passes over one warp and then passes under three warps to form a crimp which is shorter than that of the lower side wefts to sandwich the knuckle portion.

Embodiment 4

Figure 4:
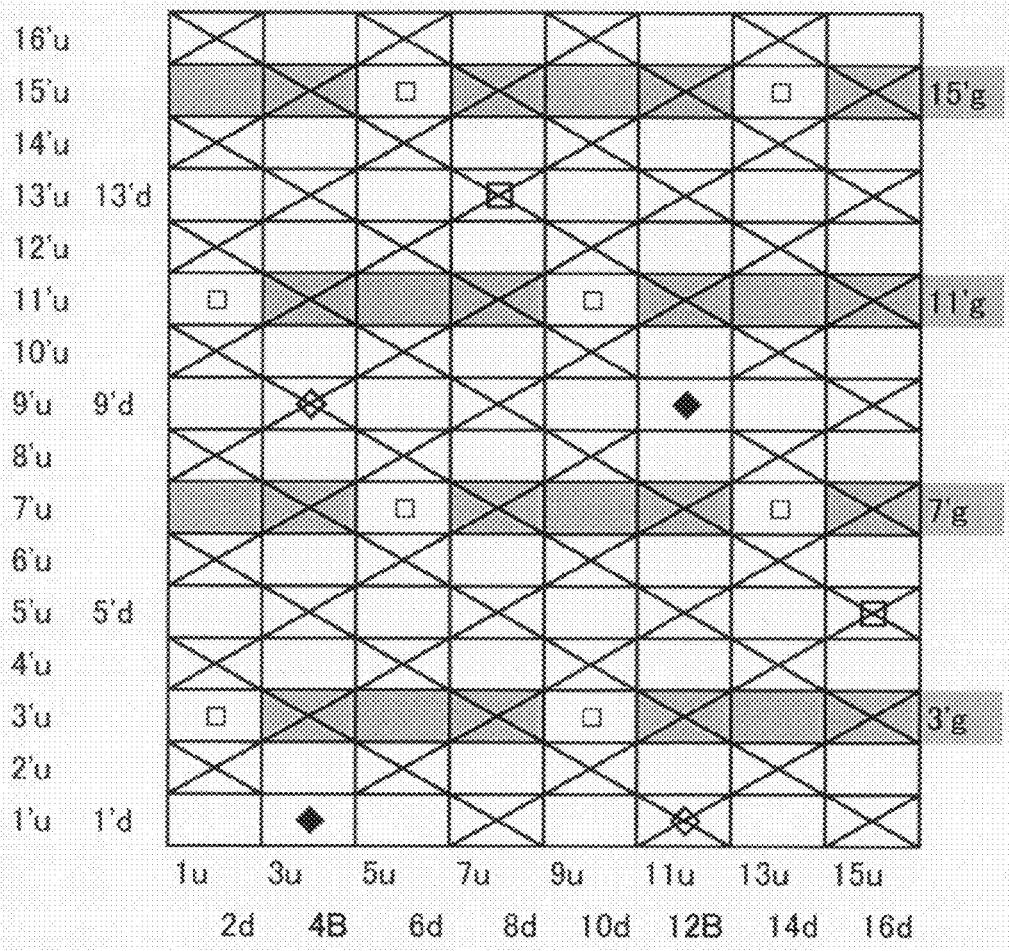
FIG. 4 is a design diagram illustrating a complete design of Embodiment 4 according to the present invention.

FIG. 4 is a design diagram of a fabric according to Embodiment 4 of the present invention. It is different from the above Embodiment in the arrangement of warp binding yarns and has a pair of an upper side warp (u) and a warp binding yarn (B). Although a binding ratio is small, a warp binding yarn forms a firm knuckle "◇" with narrower wefts so that there is no fear of separation of upper and lower layers. Even such a fabric does not pose any problem. This fabric has a similar lower side design to that of the above Embodiment.

Embodiment 5

Figure 5:
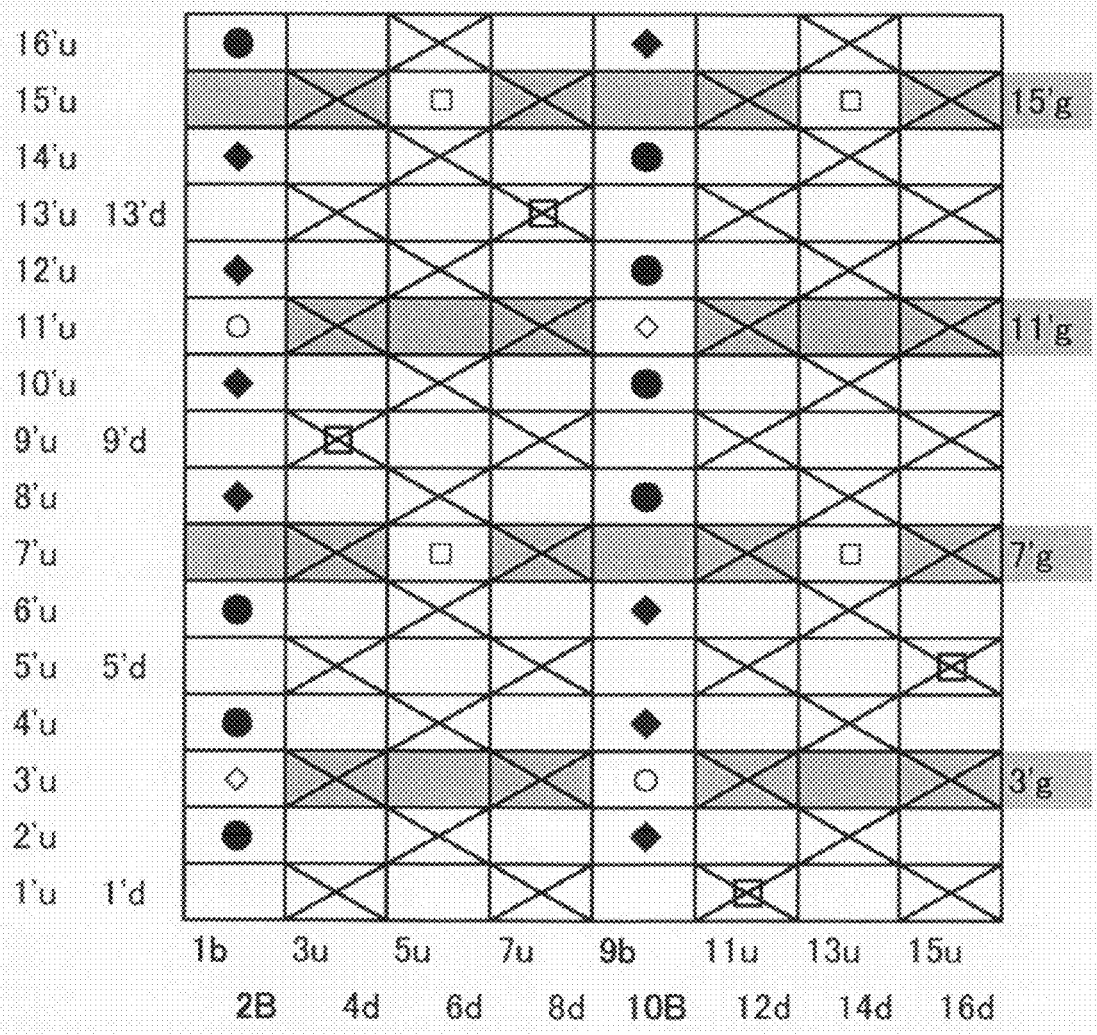
FIG. 5 is a design diagram illustrating a complete design of Embodiment 5 according to the present invention.

FIG. 5 is a design diagram of a fabric according to Embodiment 5 of the present invention. Two warp binding yarns (b, B) are arranged as a pair. These two yarns have the same design so that the number of beams of a weaving machine can be reduced upon weaving. The fabric has a similar lower side design to that of the above Embodiment.

Embodiment 6

Figure 6:
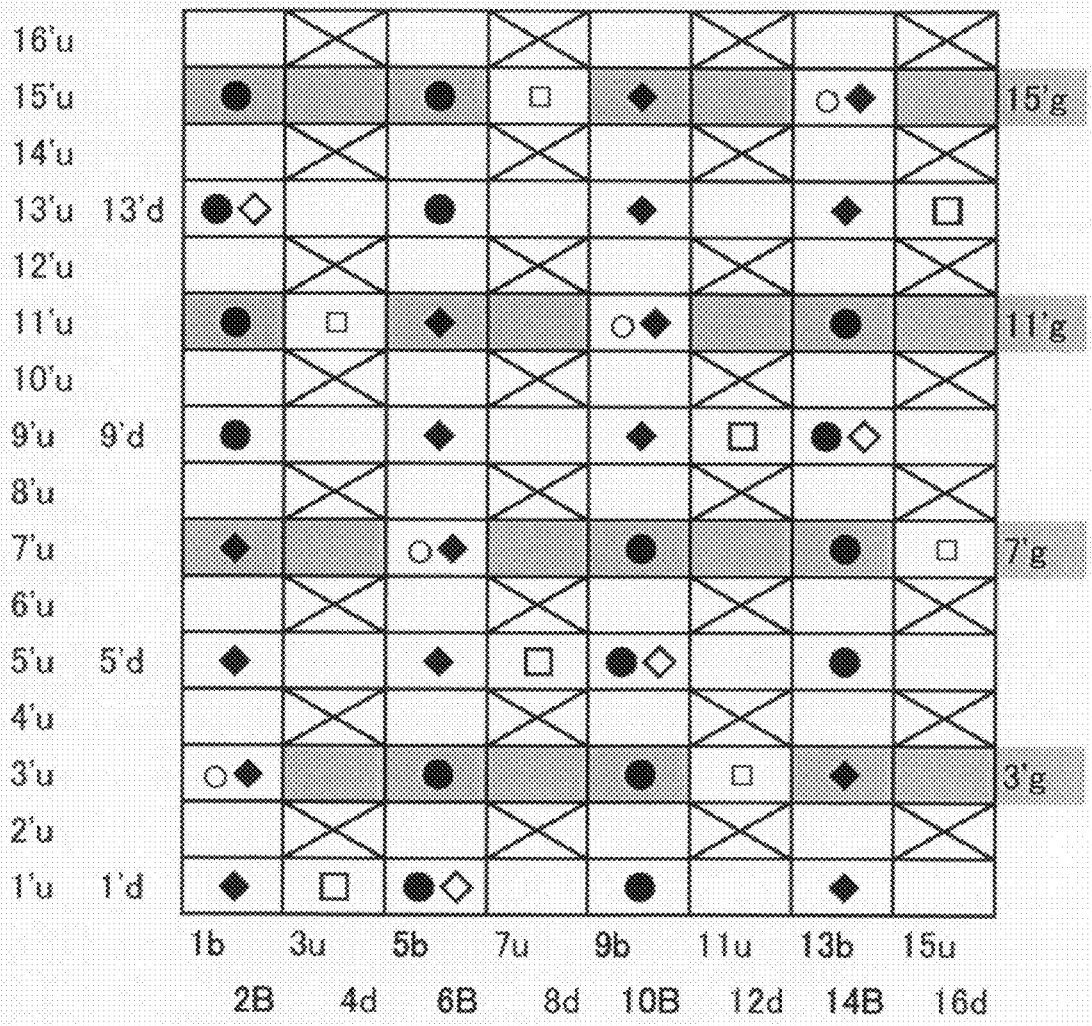
FIG. 6 is a design diagram illustrating a complete design of Embodiment 6 according to the present invention.

FIG. 6 is a design diagram of a fabric according to Embodiment 6 of the present invention. Similar to Embodiment 5, two warp binding yarns (b, B) are arranged as a pair, but an arrangement ratio of binding yarns is different. In the lower side layer, a lower side weft passes over two warps and then passes under six warps to form a long crimp. A narrower weft repeats a design in which it passes over one warp, passes under four warps, passes over one warp, and passes under two warps.

Embodiment 7

Figure 7:
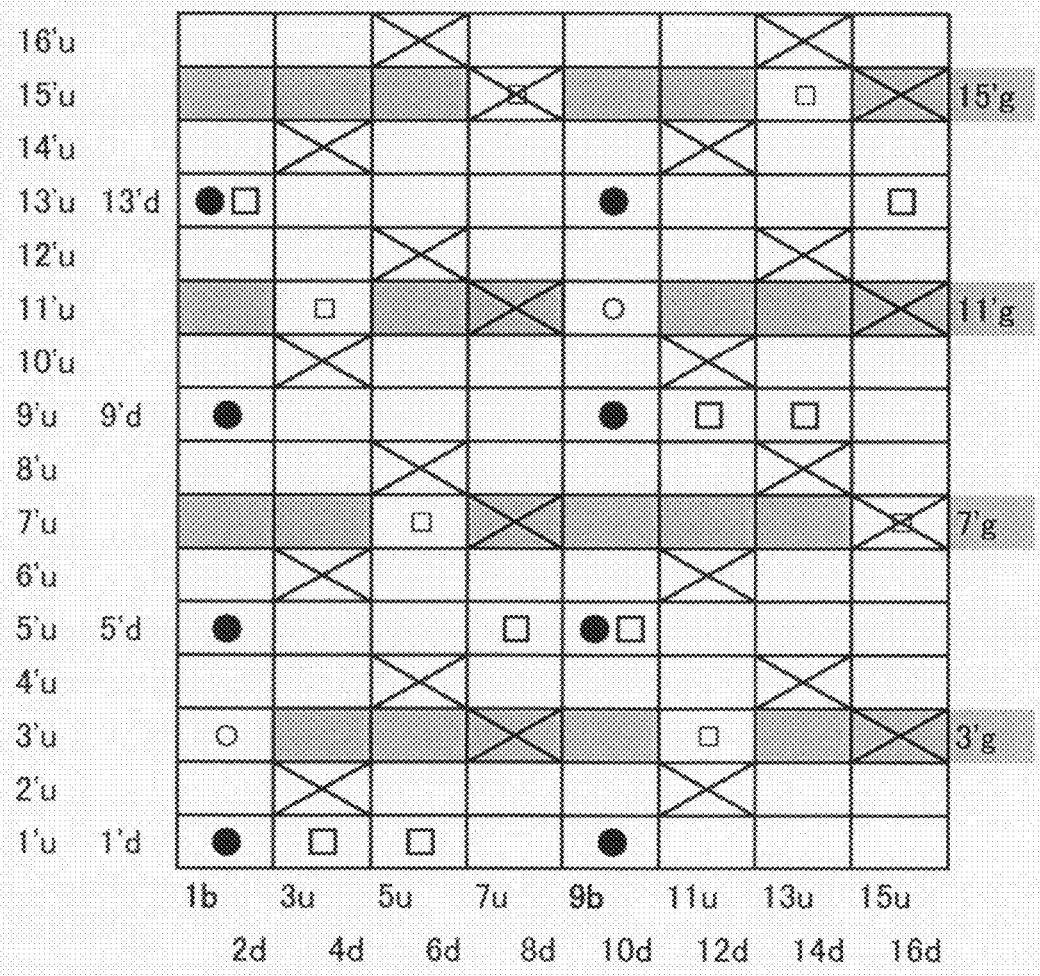
FIG. 7 is a design diagram illustrating a complete design of Embodiment 7 according to the present invention.

FIG. 7 is a design diagram of a fabric according to Embodiment 7 of the present invention. A warp binding yarn (b) and a lower side warp (d) constitute a pair. Upper side layer and lower side layer have similar designs to those of Embodiment 2, respectively.

Embodiment 8

Figure 8:
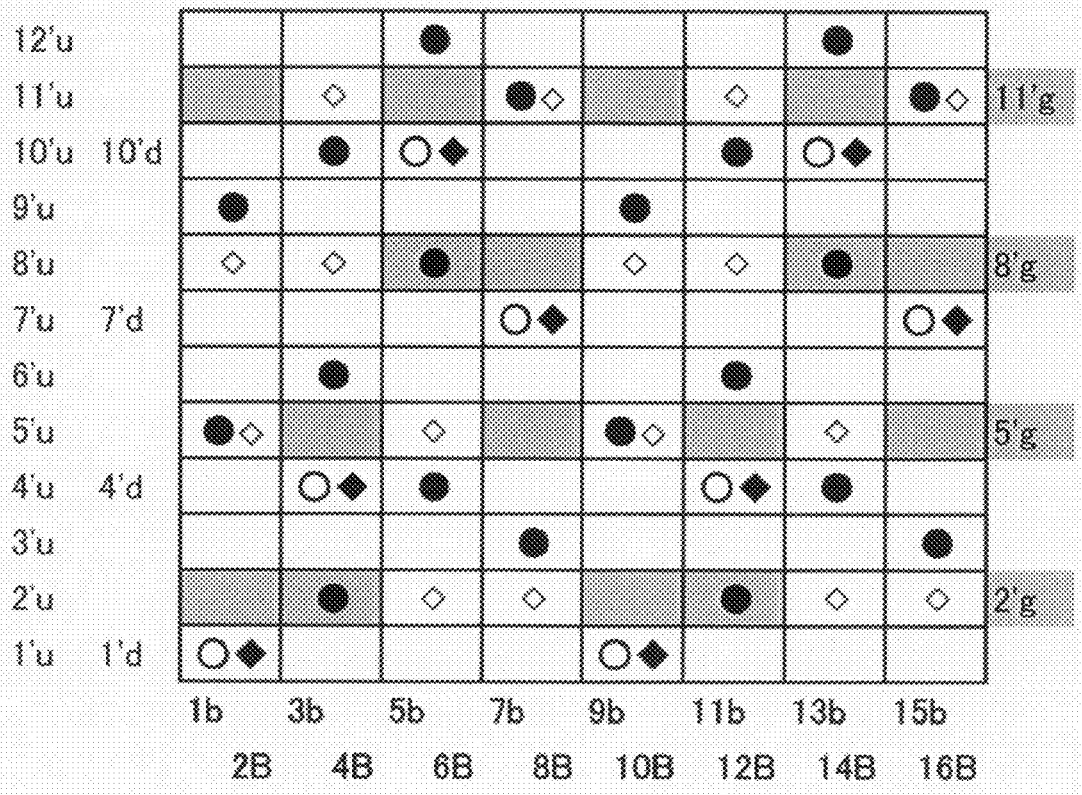
FIG. 8 is a design diagram illustrating a complete design of Embodiment 8 according to the present invention.

FIG. 8 is a design diagram of a fabric according to Embodiment 8 of the present invention. Since warps constituting the fabric are all yarns for weaving both upper side wefts and lower side wefts so that this fabric has a single warp-double weft structure. Binding yarns for weaving upper wide wefts and lower side wefts (b, B) are two warps different in design. Upper side wefts and lower side wefts are arranged at 3:2. Lower side wefts each has a design in which it passes over one warp and then passes under three warps to form a long crimp. Narrower wefts have two different designs. Narrower wefts 2'*g* and 8'*g* each repeats a design in which it passes over two warps and then passes under two warps. On the other hand, narrower wefts 5'*g* and 11'*g* each repeats a design in which it passes over one warp and passes under one warp alternately. Even though two kinds of narrower wefts different in design are arranged, a lower side knuckle of a binding yarn is sandwiched from both sides by narrower wefts so that similar to the other embodiments, the resulting fabric has improved rigidity, expansion resistance, size stability, and running stability. In addition, when endless fabrics are woven and joined to have ends in a known manner, the resulting fabric has improved joining strength.

Embodiment 9

FIG. 9 is a design diagram of a fabric according to Embodiment 9 of the present invention. In the above embodiments, two warps constitute a pair, but in this embodiment, the fabric has only one kind of a warp. In addition, the fabric has a single warp-triple weft structure having an intermediate weft arranged between an upper side weft and a lower side weft.

Figure 10:
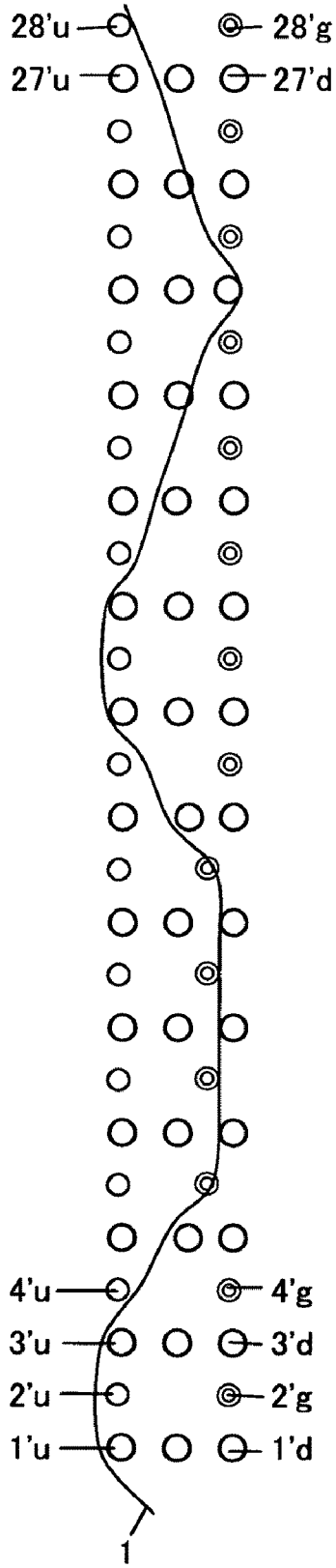
FIG. 10 is a cross-sectional view of Embodiment 9 taken along the warp.

The design diagram does not show a portion where a warp passes through an intermediate layer, but the structure can be understood referring to FIG. 10 which is a cross-sectional view along warp 1 of FIG. 9.

Embodiment 9 shows a 14-shaft fabric having a design in which a lower side weft passes over one warp and then passes under thirteen warps. A narrower weft has a design in which it passes under three warps, passes over two warps, passes under three warps, passes over one warp, passes under four warps, and then passes over one warp. This narrower weft is placed so as to sandwich a lower side knuckle of a warp from both sides. Similar to the other embodiments, the fabric according to this Embodiment has improved fabric rigidity, expansion resistance, size stability, and running stability. In addition, when endless fabrics are woven and joined to have ends in a known manner, the resulting fabric has improved joining strength.

Embodiment 10

Figure 11:
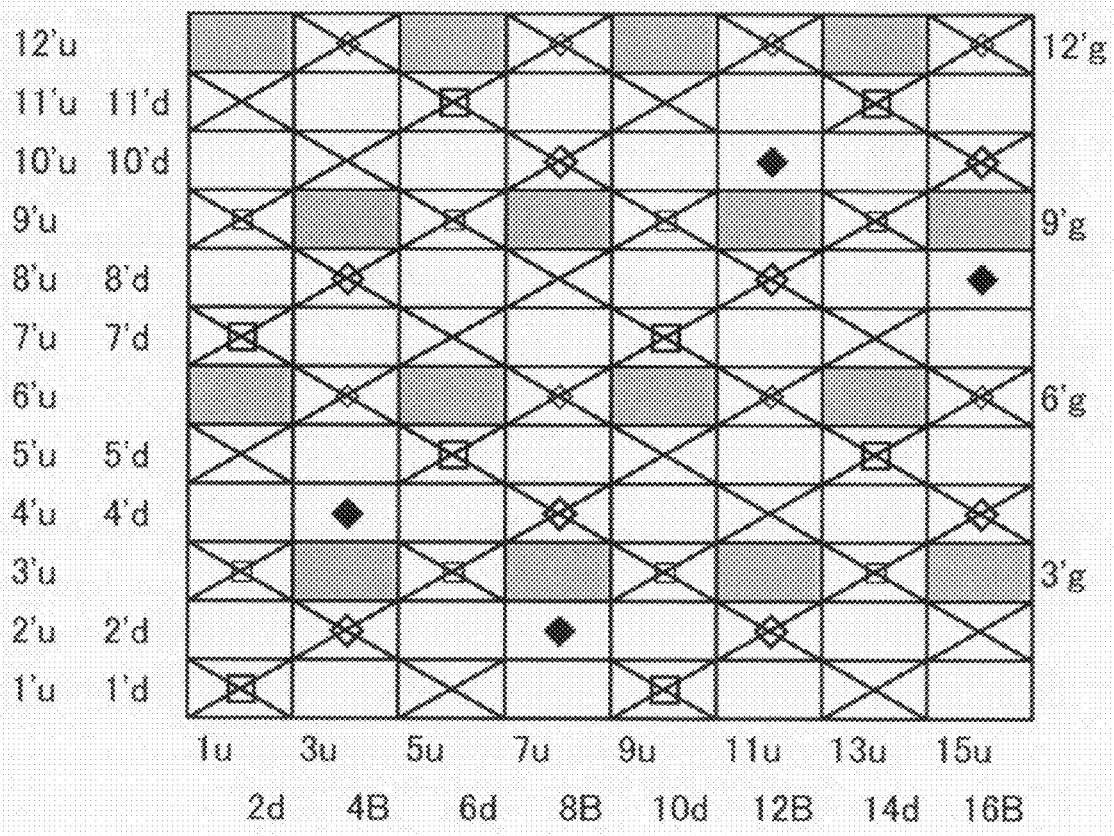
FIG. 11 is a design diagram illustrating a complete design of Embodiment 10 according to the present invention.

FIG. 11 is a design diagram of a fabric according to Embodiment 10 of the present invention. In any of the above Embodiments, a lower side weft and a narrower weft are arranged alternately. In this Embodiment, on the other hand, one narrower weft is arranged per two lower side wefts. An arrangement ratio of upper layer wefts and lower layer wefts is 1:1. A warp binding yarn is used as a binding yarn for weaving upper and lower layer wefts and an upper side warp and a warp binding yarn constitute a pair.

The lower side layer except the narrower wefts has a sateen weave design and usually in this design, two adjacent lower side wefts come close to each other in some places and separate from each other in some places. Described specifically, in sateen weave, they come close to each other where a new twill starts and they tend to separate from each other where the same twill continues. For example, a twill toward obliquely upper right is formed in lower side wefts 1'*d* and 2'*d* and a twill toward obliquely upper left is formed in lower side wefts 4'*d* and 5'*d*. Lower side wefts tend to separate from each other between lower side wefts 1'*d* and 2'*d* and Lower side wefts 4'*d* and 5'*d*, while Lower side wefts tend to come close to each other between Lower side wefts 2'*d* to 4'*d*.

When lower side wefts serving as a dehydration groove are not arranged with equal intervals, use of such a fabric as a papermaking fabric may cay cause uneven dehydration and it may lead to deterioration of the formation of paper thus obtained. It is therefore preferred to arrange lower side wefts with equal intervals.

In the present embodiment, it is possible to place narrower wefts and thereby improve uneven weft arrangement which will otherwise occur inevitably in the sateen weave design. Described specifically, arrangement of narrower wefts of a small diameter at a position where two adjacent lower side wefts will come close to each other is effective for alleviating the unevenness of the intervals with which lower side wefts are arranged.

Figure 15:
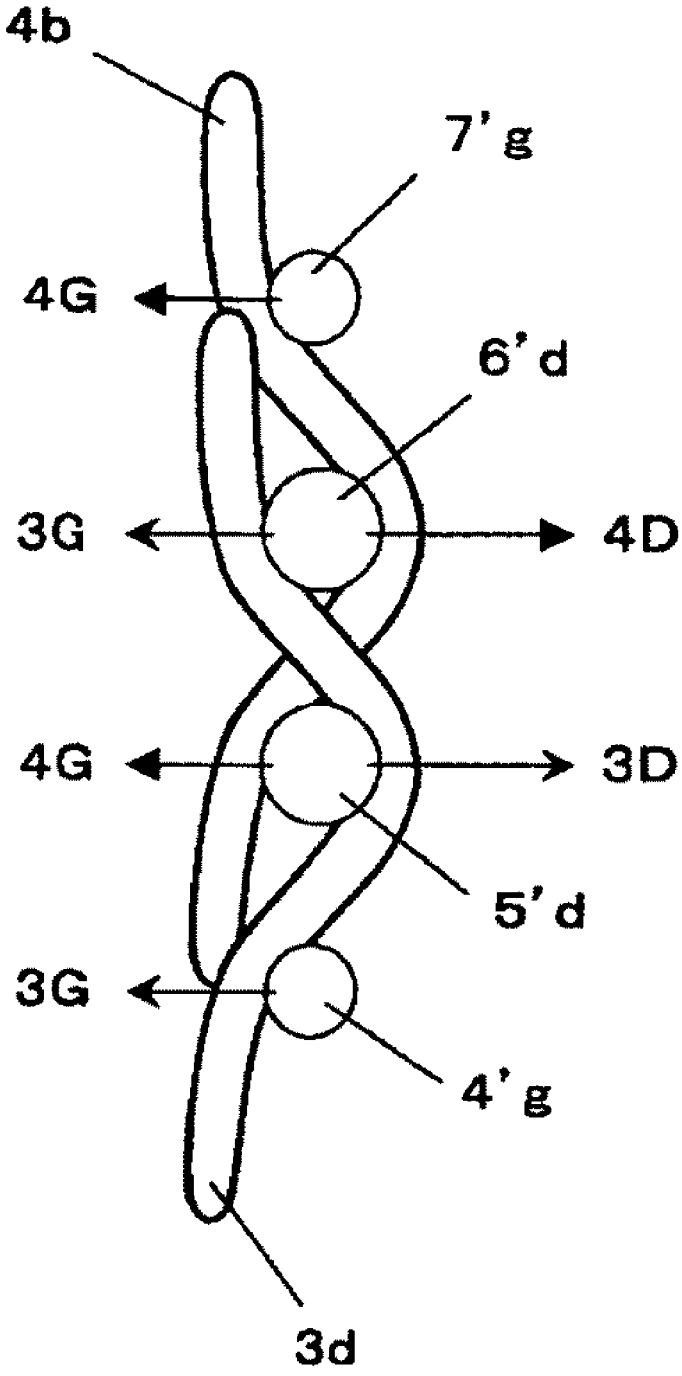
FIG. 15 is a cross-sectional view illustrating the vicinity of a knuckle formed by the two warps of Embodiment 10 on the lower surface side.

As in the other embodiments, the present embodiment also produces an effect of improving firmness of the confounding portion of the lower surface side knuckle of a warp. FIG. 15 corresponds to a cross-sectional view illustrating a portion of two warps of this embodiment. Even when two adjacent lower side wefts are arranged successively, a knuckle is sandwiched between two narrower wefts arranged both sides of these wefts. As a result, the fabric thus obtained has improved rigidity, expansion resistance, size stability, and running stability. In addition, when endless fabrics are joined by weaving into fabrics with ends by the known method, the resulting fabric has improved joining strength.

What is claimed is:

1. An industrial multilayer fabric obtained by stacking at least upper side wefts and lower side wefts one after another and weaving them with warps, the industrial multilayer fabric having an upper side surface and a lower side surface comprising:

a narrower weft which is arranged between the lower side wefts and is smaller than the lower side weft in diameter;

a first crimp on the lower side surface formed by the narrower weft at a first place where the narrower weft passes under the warp or warps between first spots where the warps pass under the narrower weft;

a second crimp on the lower side surface formed by the lower side weft at a second place where the lower side weft passes under the warps between second spots where the warps pass under the lower side weft, wherein a number of the warp or warps that pass over the first crimp is less than another number of the warps that pass over the second crimp; and a knuckle on the lower side surface formed by the warp that passes under the one lower side weft;

wherein the two adjacent first crimps sandwich the knuckle or two adjacent knuckles in a repeating unit.

2. The industrial multilayer fabric according to claim 1, wherein the two adjacent knuckles are formed by two adjacent warps that pass under the same one lower side weft.

3. The industrial multilayer fabric according to claim 1, wherein the two adjacent knuckles are formed by two adjacent warps, each of which passes under different one of two adjacent lower side wefts.

4. The industrial multilayer fabric according to claim 1, wherein the narrower wefts and the lower side wefts are arranged at a ratio of 1:1 or 1:2.

5. The industrial multilayer fabric according to claim 1, wherein the multilayer fabric has any one of a single warp-double weft structure, a double warp-double weft structure, and a single warp-triple weft structure.

6. The industrial multilayer fabric according to claim 1, wherein the multilayer fabric is obtained by weaving with a single warp binding yarn, a pair of warp binding yarns, a single weft binding yarn, or a pair of weft binding yarns.

7. The industrial multilayer fabric according to claim 1, wherein the narrower wefts arranged between the lower side wefts have one design or two or more different designs.

* * * * *